United States Patent [19]

West

[11] Patent Number: 5,018,292

[45] Date of Patent: May 28, 1991

[54] LINKAGE ASSEMBLY FOR TRIGGER/SEAR ASSEMBLIES

[76] Inventor: Dennis E. West, 1612 Weatherstone Ct., Blue Springs, Mo. 64015

[21] Appl. No.: 459,431

[22] Filed: Jan. 2, 1990

[51] Int. Cl.[5] ..... F41A 19/10; F41A 19/12; F41A 19/16

[52] U.S. Cl. ..... 42/69.02

[58] Field of Search ..... 42/69.02, 70.04, 70.05, 42/41, 69.01, 69.03

[56] References Cited

U.S. PATENT DOCUMENTS

| | | | |
|---|---|---|---|
| 1,693,530 | 11/1928 | Spencer | 42/69.02 |
| 2,053,489 | 9/1936 | Norman | 42/70.04 |
| 2,466,196 | 4/1949 | Baker | 42/69.03 |
| 2,659,994 | 11/1953 | Yale | 42/69.02 |
| 2,927,390 | 3/1960 | Lewis | 42/69.03 |
| 3,128,570 | 4/1964 | Browning | 42/70.04 |
| 3,142,926 | 8/1964 | Morrow | 42/69.01 |
| 3,206,884 | 9/1965 | Purvis | 42/69.01 |
| 4,203,348 | 5/1980 | Sokolovsky | 42/70.05 |
| 4,276,808 | 7/1981 | York | 89/136 |
| 4,667,429 | 5/1987 | Perazzi | 42/69.01 |
| 4,685,379 | 8/1987 | Troncoso | 42/69.01 |
| 4,803,910 | 2/1989 | Troncoso | 89/136 |

*Primary Examiner*—Michael Carone

[57] ABSTRACT

A linkage assembly comprises a trigger mounting bracket with a linkage bar extending between the trigger and sear assemblies. The linkage bar includes a notch cooperating with a track to preset longitudinal movement of the linkage bar during use. An alternative embodiment presents trigger and sear brackets with a linkage bar adjustable in length therebetween. The assemblies allow for displacement of the conventional trigger and sear assemblies from their normal position.

21 Claims, 2 Drawing Sheets

LINKAGE ASSEMBLY FOR TRIGGER/SEAR ASSEMBLIES

BACKGROUND OF THE INVENTION

This invention relates to a linkage assembly for transmitting the motion of a trigger to an associated sear mechanism, and more particularly, to a linkage assembly which displaces the trigger assembly from a conventionally mounted position.

Various available weapons such as rifles, automatic pistols and the like are equipped with a conventional trigger and sear assembly combination. Upon pulling the trigger, the motion is transmitted to the sear, via intermediate linkage, so that the sear releases the bolt. Upon such release the weapon is fired.

In some cases it may be desirable to adjust the conventional, longitudinal relationship between the trigger assembly and sear assembly. The reasons for such an adjustment may vary according to the type of weapon. I have directed the following discussion to a Remington Model XP-100 Bolt Action Pistol. This firearm is a single shot pistol which I have primarily used in target shooting. The conventional position of the trigger assembly positions the trigger assembly in front of the rear sight and adjacent the handle/grip of the stock. I believe that several disadvantages arise from such relationships. The sight picture presented by the conventional model positions the rear sight close to the eye. By rearwardly displacing the trigger assembly along with the grip, I forwardly move the whole barrel and sight assemblies. I believe that this displacement improves the sight definition. Thus, it is desirable to move the trigger assembly to the rear of the rear sight.

Also, as the trigger assembly is rearwardly displaced the grip of the gun is concurrently rearwardly displaced. By displacing the grip of the gun behind the rear sight the imaginary pivot point of the barrel is now behind the rear sight. I believe that the displacement of this pivot point behind the rear sight improves aiming.

I have also found that the rearward displacement of the trigger assembly and accompanying handle makes the gun more muzzle heavy so that there is the impression of less recoil and displacement of the weapon upon firing. This weight displacement along with the above-mentioned pivot point position allows for a steadier hold upon aiming which improves shooting accuracy.

Accordingly, a required displacement of the trigger assembly requires a change in the structure of the intermediate linkage assembly so as to transmit the motion of the trigger to the sear.

In response thereto I have invented a novel linkage assembly which easily displaces the trigger assembly towards the sear mechanism and allows for effective transmission of motion therebetween. One form of linkage assembly comprises a trigger mounting bracket for attachment to the barrel assembly. A linkage bar cooperates with a track in this trigger bracket so as to transmit the motion of the pulled trigger to the sear and cause gun firing. One embodiment of the linkage assembly allows for adjustment/fine tuning of the linkage length so as to enhance the linkage function. The use of my linkage assembly requires a new stock design which displaces the grip of the gun to the rear and a forward displacement of the barrel assembly.

It is understood that my invention is disclosed in relationship to a Remington XP-100. However, the teachings therein may be readily utilized in other firearms so as to increase or decrease the distance between the trigger and sear assemblies and obtain the accompanying advantageous results thereof.

Accordingly it is a general object of this invention to provide a linkage assembly for adjusting the spatial relationship between the trigger and sear assemblies.

Another object of this invention is to provide a linkage assembly, as aforesaid, which allows for selectable displacement of the trigger assembly relative to the sear assembly.

A further object of this invention is to provide a linkage assembly, as aforesaid, which is adaptable for use with guns of various design.

Still a further particular object of this invention is to provide a linkage assembly, as aforesaid, which allows for length adjustment and/or fine tuning of the linkage between the trigger and sear assemblies.

Another particular object of this invention is to provide a linkage assembly, as aforesaid, which utilizes a trigger bracket/linkage bar combination.

Still a further object of the invention is to provide a linkage assembly, as aforesaid, which improves the sight picture, weight distribution and aiming point of the associated firearms.

A more particular object of this invention is to provide a linkage assembly, as aforesaid, which reduces the mass of the conventional linkage assembly.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 7 is a sectional view, on an enlarged scale, illustrating the use of the linkage assembly of FIG. 6.

DESCRIPTION OF THE PREFERRED EMBODIMENT

Figure 1:
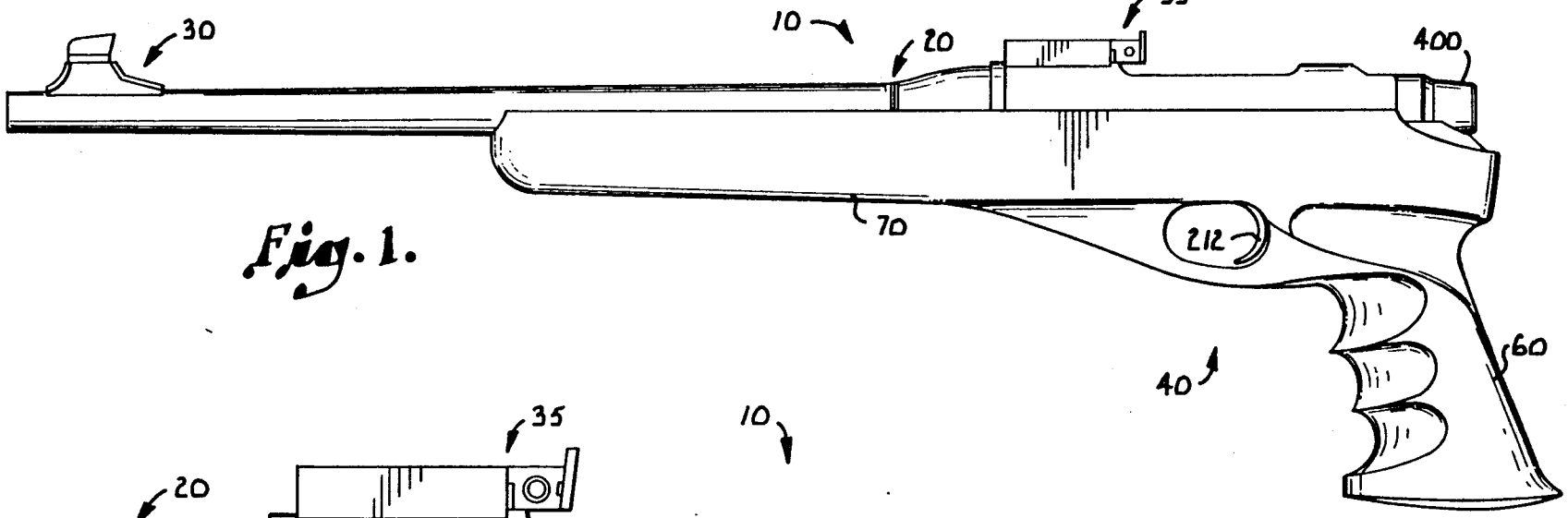
FIG. 1 is a side elevation view of the firearm illustrating the new stock design for use with the linkage assembly.

Turning more particularly to the drawings, FIG. 1 illustrates a Remington XP-100 equipped with a new stock 40 as required by use of my novel linkage assembly 100. As illustrated, the gun 10 comprises a barrel assembly 20 having front 30 and rear 35 sights. A stock 40, adapted for use with the rearwardly displaced trigger assembly 200, comprises a grip 60 with an underlying hand rest 70 thereon. The linkage assembly 100 transmits the motion of the pulled trigger 212 of trigger assembly 200 to the sear mechanism 500. Activation of the sear assembly 500 releases the bolt 400 of the firearm 10 so that the firing pin strikes the bullet.

The trigger assembly 200 generally comprises a housing 210 having longitudinal side walls 211, 213 and a lateral front wall 218 with the trigger 212 pivotally mounted thereto by means of a horizontal trigger pin 214. A trigger adjustment screw 216 extends through the front face 218 of the housing 210 so as to adjust the variance of the trigger 212 pull.

Prior to my invention the trigger assembly 200 was mounted in a forward position beneath the rear sight 35. The trigger housing 210 was attached to a depending mounting bracket 280 by means of trigger housing screws 224, 226 functionally extending through apertures 221, 223 in outwardly extending flanges 220, 222 of the housing 210 and apertures 282 in the bracket 280. These flanges 220, 222 were mounted to the forward side of the bracket 280 so that the housing 210 is positioned on the left side of bracket 280 as viewed in FIG. 2.

Figure 5:
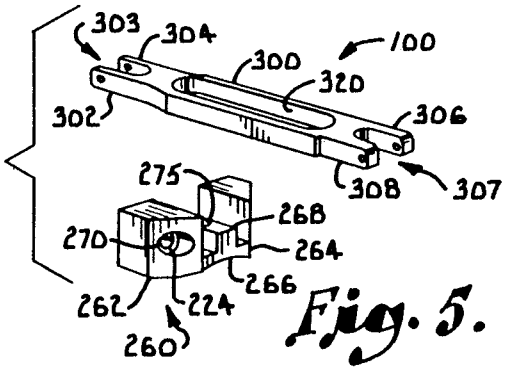
FIG. 5 is an exploded view illustrating the linkage assembly.
Figure 1:
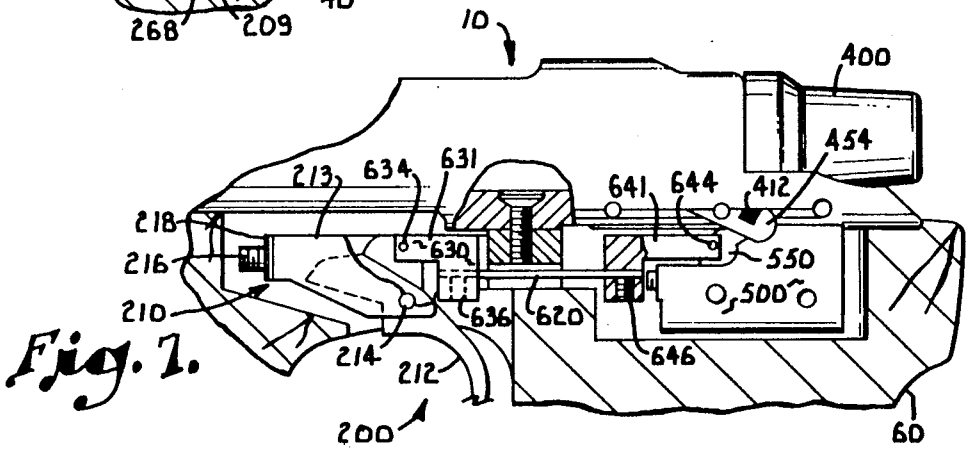

As shown in FIG. 5, in order to achieve a rearward displacement of the trigger housing 200 and the above-discussed accompanying results, I provide a trigger mounting bracket 260 which comprises a pair of mounting blocks 262, 264 having a spanning track 266 with a central rail 268. Extending through the blocks 262, 264 are horizontal apertures 270 for receiving screws 224, 226 therein. These screws 224, 226 extend through the mounting blocks 262, 264 and into &he threaded apertures 221, 223 in the mounting flanges 220, 222 of housing 210. Upon threadable engagement of the screws 224, 226, the mounting bracket 260 is secured to the trigger housing 210.

Figure 4:
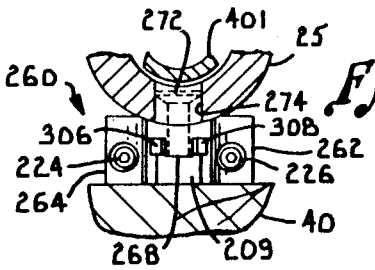
FIG. 4 is a sectional view, taken along line 4—4 in FIG. 2 to illustrate the relationship between the track and linkage bar as well as the attachment of the trigger bracket to the receiver.

Aperture 275 vertically extends through the rail 266 for receiving a screw 272 therein which threadably engages an aperture 274 in the receiver. This aperture 274 was formerly used to secure the receiver assembly to the gun's original stock but can be drilled into the barrel receiver in other applications. FIG. 4 illustrates the manner of attachment of the bracket 260 to the receiver 25 (fragmentarily shown) of the barrel assembly 20. A portion 401 of the bolt 400 is shown to indicate the lack of interference between the screw 272 and bolt 401. Underlying the bracket 260 is a portion of the stock 40. It is noted that the bracket 260 has been shown in FIG. 5 in an inverted position for purposes of illustration. The bracket 260, as shown in FIG. 4, is mounted so that the track 266 is adjacent the receiver 25 with the rail 268 depending therefrom.

Figure 2:
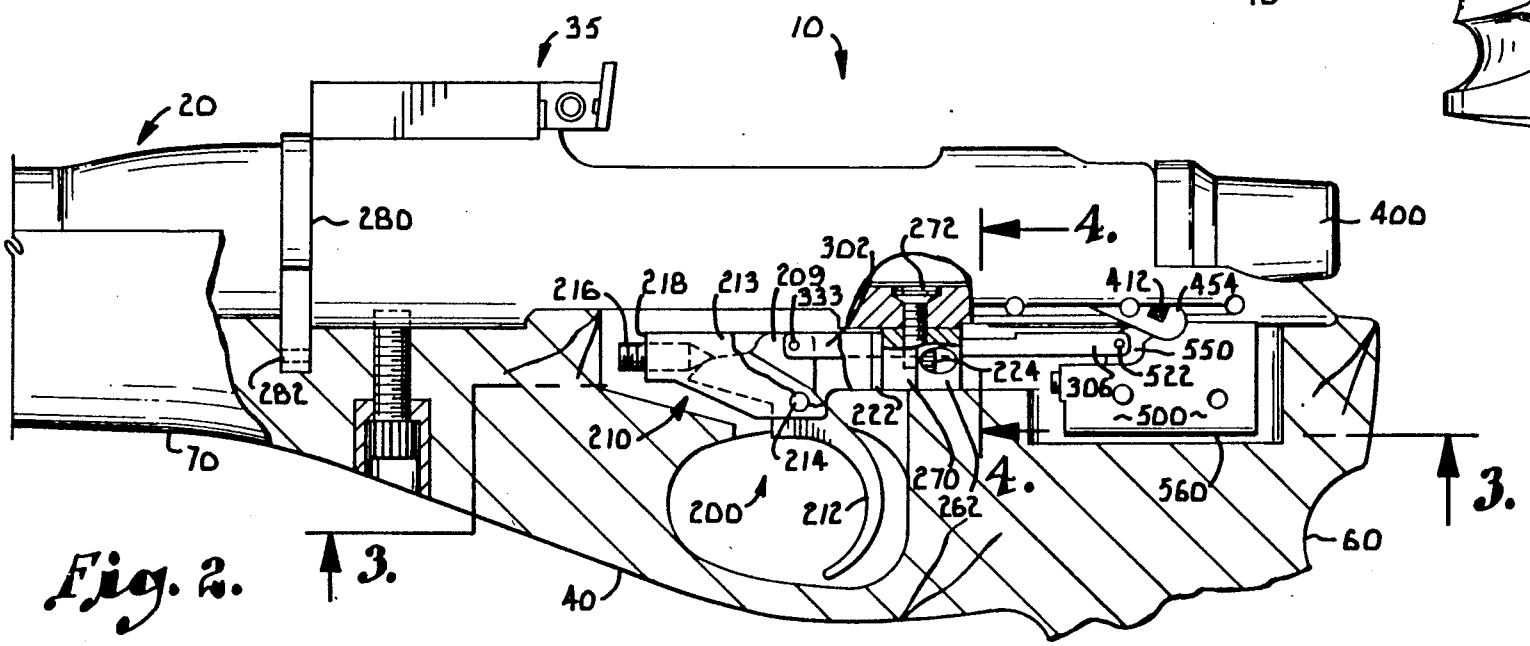
FIG. 2 is a fragmentary sectional view, on an enlarged scale, illustrating the relationship among the trigger, sear and linkage assemblies with a portion of the receiver broken away to illustrate the attachment of the trigger bracket to the receiver.
Figure 3:
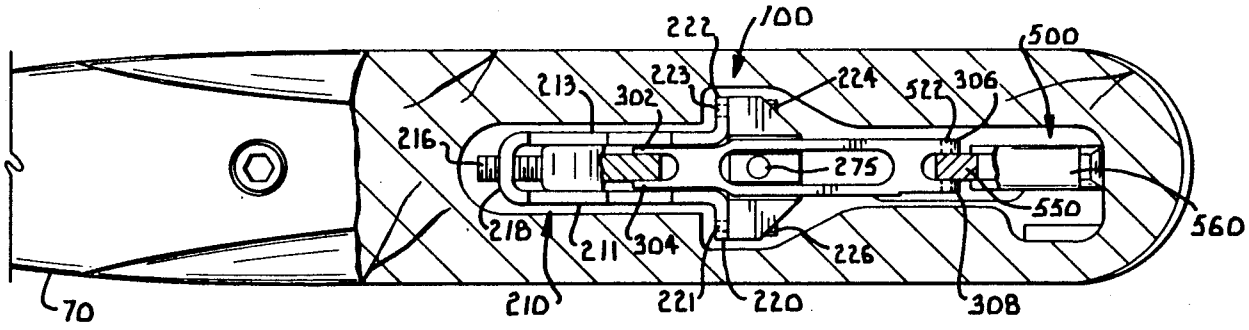
FIG. 3 is a sectional view, taken along line 3—3 in FIG. 2, illustrating the underside of the linkage assembly with a portion of the trigger and sear assemblies broken away to illustrate the attachment of the linkage bar brackets thereto.

A linkage bar 300 includes a trigger bracket 303 having a pair of laterally displaced trigger mounting arms 302, 304 and a sear bracket 307 having a pair of laterally displaced sear mounting arms 306, 308. A trigger link pin 333 extends through bracket arm 302, the upper lobe 209 of the trigger 212 and the opposed bracket arm 304. As shown in FIG. 3 the bracket arms 302, 304 are located within the side walls 211, 213 of housing 210. FIG. 2 illustrates the trigger housing 210 with one wall 213 broken away to show the pin 333/arm 302/trigger 212 combination.

A sear pin 522 extends through bracket arm 306, sear block 550 of the sear assembly 500 and opposed sear bracket arm 308. A portion of the bottom wall 560 of the sear assembly 500 has been broken away in FIG. 3 to illustrate this sear block 550 connection.

The linkage bar 300 presents a central longitudinally notch 320 which allows for a downward projection, as viewed in FIG. 4, of the rail 268 of track 266 therethrough. This rail 268/notch 320 relationship may guide the linkage bar 300 into a reciprocal, longitudinal directions in some designs. There is preferably no contact between the rail 268 and notch 320. Lateral movement is controlled by contact of the bracket arms 302 and 304 with the side walls 211, 213 of housing 210.

Upon attachment of the trigger mounting bracket 260 to the barrel receiver 25 and attachment of the linkage bar 300 bracket 307 to the sear block 550, motion of the pulled trigger 212 is transmitted to the sear block 550 by the motion of the linkage bar 300. Upon such motion the conventional action of the sear block 550 causes the bolt release 454 to clear a stop lug (not shown) on bolt 400. This action allows the firing pin (not shown) to strike the loaded round and fire the weapon 10.

It is here understood that my novel linkage assembly 100 is easily attached to conventional trigger and sear assemblies. The mounting bracket 260 is attached to the underside of the receiver 25 by means of screw 272. The linkage bar 300 is attached to the trigger 200 and sear 500 assemblies by the respective brackets 303, 307. Thus, my invention, as above described, is adaptable for use with various weapons.

Figure 6:
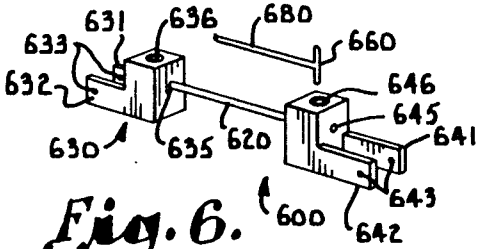
FIG. 6 is a view of an alternative embodiment of the linkage assembly with an alternative linkage bar to be used therewith.

An alternative embodiment 600 of my invention is as shown in FIGS. 6 and 7. Again the device is shown in an inverted position to enhance illustration. This embodiment presents an adjustable linkage bar 620 which is particularly adapted for use with rifle-style triggers.

Assembly 600 presents a trigger mounting block arms 631, 632 and sear mounting block arms 641, 642. Each bracket arm has apertures 633, 643 therein for receiving a pin 634, 644, therethrough for connection to the trigger 200 and sear 500 assemblies. The linkage bar 620 is held in place by set screws 636, 646 bearing against its ends. Thus the length of bar 620 between blocks 630, 640 can be varied in accordance with a desired displacement between the trigger 200 and sear 500 assemblies.

As shown in FIG. 7 the assembly 600 is inverted from its FIG. 6 position. Pin 634 extends through the bracket arms 631, 632 and the upper lobe 209 of trigger 212. A portion of the side wall 213 of housing 210 has been broken away to illustrate the arm 631, pin 634, lobe 209 combination.

Pin 644 extends through arms 641, 642 and the sear block 550. A portion of the bracket 640 has been broken away to illustrate the set screw 646 bearing against the end of bar 620. Thus, action of the trigger 212 is transmitted to the sear block 550 by this linkage 600. Again it is understood that the trigger 200 and sear 500 assemblies work in a conventional manner.

It is understood that certain sear assemblies, e.g. generally those designed for rifles, have a sear block with the trigger 212 as an integral part of the sear block with no means of attaching the trigger mounting bracket 640 in the manner described above. This sear block can be modified by removing the trigger itself, similar to 212, and machining a keyhole which will accept flared end 660 of an alternative linkage bar 680. This flared end 660 is inserted into the keyhole-type aperture of the sear block similar to 550 and rotated 90° into engagement with the sear block. In such instances the use of mounting block 640 is not required. The trigger mounting block 630 is used as above described so that the motion of the pulled trigger 212 is transmitted to the sear block 550 via linkage 680. Thus, the assembly 600 as modified with the alternative linkage bar 680 allows a trigger to be displaced from the sear assembly. This relationship was not available with the earlier combined trigger and sear assembly. Accordingly, various triggers may now be used and displaced from the sear assembly which previously incorporated the trigger therein.

Although certain forms of this invention have been illustrated and described it is understood that they are not to be limited thereto except as set forth in the following claims and functional equivalents thereof.

Having thus described the invention, what is claimed as new and desired to be secured by Letters Patent is:

1. In a firearm having a trigger assembly and sear assembly, linkage apparatus between said assemblies for transmitting motion of said trigger assembly to said sear assembly to fire said firearm, said linkage apparatus comprising:

a trigger bracket having a pair of spaced apart mounting blocks with a central track therebetween;

means for mounting said bracket to said firearm;

means for mounting said bracket to said trigger assembly;

a linkage bar having first and second ends;

means on said linkage bar for receiving said track therein;

means for mounting said first end of said bar to said trigger assembly; and means for mounting said second end of said bar to said sear assembly, said linkage bar transmitting motion of said trigger assembly to said sear assembly for operation of said firearm.

2. The apparatus as claimed in claim 1, wherein said receiving means on said linkage bar comprises a slot for projection of a portion of said track therethrough.

3. The apparatus as claimed in claim 1, wherein said means for mounting said trigger bracket to said firearm comprises:

an aperture underlying a gun barrel of said firearm;

an aperture in said track and aligned with said gun barrel aperture; and fastener means extending through said aligned apertures and engaging the same, whereby said bracket is positioned beneath said barrel.

4. The apparatus as claimed in claim 1, wherein said means for mounting said first end of said bar to said trigger assembly comprises:

first and second laterally spaced apart arms extending from said first bar end;

an aperture in each arm and laterally aligned therebetween;

a pin extending through said apertures and a portion of a trigger of said trigger assembly positioned therebetween, whereby movement of said trigger about said pin is transmitted to said arms.

5. The apparatus as claimed in claim 1, wherein said means for mounting said second end of said bar to said sear assembly comprises:

first and second laterally spaced arms extending from said second end of said bar;

an aperture in each arm and in alignment therebetween;

a pin extending through said arm apertures and a portion of said sear assembly positioned therebetween, whereby movement of said linkage bar is transmitted to said sear assembly for movement about said pin.

6. The apparatus as claimed in claim 1, wherein said means for mounting said trigger bracket to said trigger assembly comprises:

an aperture extending through each of said mounting blocks;

a fastener extending through each of said apertures in said mounting blocks; and said fastener having a free end extending beyond said associated mounting blocks for engaging said trigger assembly.

7. In a firearm having a trigger assembly and sear assembly, linkage apparatus between said assemblies for transmitting motion of said trigger assembly to said sear assembly to fire said firearm, said linkage apparatus comprising;

a trigger bracket;

means for mounting said bracket to said trigger assembly comprising;

first and second laterally spaced apart arms extending from a body of said bracket;

an aperture in each arm and laterally aligned therebetween;

a pin extending through said apertures and a portion of a trigger of said trigger assembly positioned therebetween, whereby movement of said trigger of said trigger assembly about said pin is transmitted to said arms;

a linkage bar having first and second ends;

means for mounting said first end of said bar to said trigger bracket;

means for mounting said second end of said bar to said sear assembly; and means for adjusting the length of said linkage bar between said trigger and sear assemblies, said adjustable linkage bar transmitting motion of said trigger assembly to said sear assembly for operation of said firearm.

8. The apparatus as claimed in claim 7, wherein said adjusting means comprises:

an aperture in said trigger bracket for receiving a selectable length of said first end of said linkage bar therein; and means for maintaining said first end of said bar in said trigger bracket.

9. The apparatus as claimed in claim 8, wherein said maintaining means comprises:

a bore extending between an exterior face of said bracket and said linkage bar; and a set screw extending through said bore and bearing against said first bar end.

10. The apparatus as claimed in claim 7, wherein said second bar end mounting means further comprises:

a sear bracket;

means for mounting said second bar end to said bracket; and means for mounting said sear bracket to said sear assembly, said adjustable linkage bar transmitting motion of said trigger assembly to said sear bracket and said sear assembly connected thereto.

11. The apparatus as claimed in claim 10, wherein said means for mounting said second bar end to said bracket comprises:

an aperture in said sear bracket for receiving a selectable length of said second end of said ba therein; and means for maintaining said second end of said bar in said sear bracket.

12. The apparatus as claimed in claim 11, wherein said maintaining means comprises:
a bore extending between an exterior face of said sear bracket and said linkage bar second end; and
a set screw extending through said bore and bearing against said second bar end.

13. The apparatus as claimed in claim 10, wherein said mounting means for said sear bracket comprises:
first and second laterally spaced apart arms extending from a body of said sear bracket;
an aperture in each arm;
a pin extending through said apertures and a portion of said sear assembly positioned therebetween, whereby movement of said linkage bar by said trigger assembly is transmitted to said sear assembly.

14. The apparatus as claimed in claim 7, wherein said means for mounting said second end of said bar to said sear assembly comprises:
a keyed end at said second end of said bar; and
means in said sear assembly for receiving said keyed end in a key/lock relationship therebetween, whereby motion of said bar is transmitted to said sear assembly.

15. In a firearm having a trigger assembly and sear assembly, linkage apparatus between said assemblies for transmitting motion of said trigger assembly to said sear assembly to fire said firearm, said linkage apparatus comprising:
a trigger bracket;
means for mounting said bracket to said trigger assembly;
a linkage bar having first and second ends;
means for mounting said first end of said bar to said trigger bracket;
means for mounting said second end of said bar to said sear assembly; and
means for adjusting the length of said linkage bar between said trigger and sear assemblies, said adjusting means comprising:
an aperture in said trigger bracket for receiving a selectable length of said first end of said linkage bar therein; and
means for maintaining said first end of said bar in said trigger bracket;
said adjustable linkage bar transmitting motion of said trigger assembly to said sear assembly for operation of said firearm.

16. The apparatus as claimed in claim 15, wherein said maintaining means comprises:
a bore extending between an exterior face of said bracket and said linkage bar; and
a set screw extending through said bore and bearing against said first bar end.

17. In a firearm having a trigger assembly and sear assembly, linkage apparatus between said assemblies for transmitting motion of said trigger assembly to said sear assembly to fire said firearm, said linkage apparatus comprising:
a trigger bracket;
means for mounting said bracket to said trigger assembly;
a linkage bar having first and second ends;
means for mounting said first end of said bar to said trigger bracket;
means for mounting said second end of said bar to said sear assembly, said second bar end mounting means comprising:
a sear bracket;
means for mounting said second bar end to said bracket; and
means for mounting said sear bracket to said sear assembly;
means for adjusting the length of said linkage bar between said trigger and sear assemblies, said adjustable linkage bar transmitting motion of said trigger assembly to said sear assembly for operation of said firearm.

18. The apparatus as claimed in claim 17, wherein said means for mounting said second bar end to said bracket comprises:
an aperture in said sear bracket for receiving a selectable length of said second end of said bar therein; and
means for maintaining said second end of said bar in said sear bracket.

19. The apparatus as claimed in claim 18, wherein said maintaining means comprises:
a bore extending between an exterior face of said sear bracket and said linkage bar second end; and
a set screw extending through said bore and bearing against said second bar end.

20. The apparatus as claimed in claim 17, wherein said mounting means for said sear bracket comprises:
first and second laterally spaced apart arms extending from a body of said sear bracket;
an aperture in each arm;
a pin extending through said apertures and a portion of said sear assembly positioned therebetween, whereby movement of said linkage bar by said trigger assembly is transmitted to said sear assembly.

21. In a firearm having a trigger assembly and sear assembly, linkage apparatus between said assemblies for transmitting motion of said trigger assembly to said sear assembly to fire said firearm, said linkage apparatus comprising:
a trigger bracket;
means for mounting said bracket to said trigger assembly;
a linkage bar having first and second ends;
means for mounting said first end of said bar to said trigger bracket;
means for mounting said second end of said bar to said sear assembly, said sear assembly comprising:
a keyed end at said second end of said bar; and
means in said sear assembly for receiving said keyed end in a key/lock relationship therebetween, whereby motion of said bar is transmitted to said sear assembly;
means for adjusting the length of said linkage bar between said trigger and sear assemblies, said adjustable linkage bar transmitting motion of said trigger assembly to said sear assembly for operation of said firearm.

* * * * *